US006502594B1

(12) United States Patent
Gerstmar

(10) Patent No.: US 6,502,594 B1
(45) Date of Patent: Jan. 7, 2003

(54) TEMPORARY CANOPY STRUCTURE

(75) Inventor: Gail L. Gerstmar, Tigard, OR (US)

(73) Assignee: Caddy Company, LLC, Tigard, OR (US)

( * ) Notice: Subject to any disclaimer, the term of this patent is extended or adjusted under 35 U.S.C. 154(b) by 0 days.

(21) Appl. No.: 09/574,400

(22) Filed: May 19, 2000

(51) Int. Cl.[7] ..... E04H 15/32

(52) U.S. Cl. ..... 135/120.1; 135/120.3; 135/124; 206/389

(58) Field of Search ..... 206/389; 242/520, 242/521, 522, 550, 570, 579, 590; 135/119, 120.3, 120.1, 124, 125

(56) References Cited

U.S. PATENT DOCUMENTS 4,844,373 A * 7/1989 Fike ..... 242/96
4,925,234 A * 5/1990 Park ..... 135/88.01
5,421,355 A * 6/1995 Cantwell ..... 135/120.3
5,450,949 A * 9/1995 Cocchi ..... 206/225
5,549,945 A * 8/1996 Lind ..... 428/35.5
5,642,810 A * 7/1997 Warner ..... 206/389
5,771,912 A * 6/1998 Swetish ..... 135/87
5,853,016 A * 12/1998 Cowan ..... 135/90
5,871,026 A * 2/1999 Lin ..... 135/98
6,006,810 A * 12/1999 Malott ..... 160/67
6,124,018 A * 9/2000 Yoshino ..... 428/122
6,210,768 B1 * 4/2001 Blok ..... 428/41.8

* cited by examiner

*Primary Examiner*—Beth A. Stephan
(74) *Attorney, Agent, or Firm*—Kolisch Hartwell, P.C.

(57) ABSTRACT

Canopy structure for creating, selectively and removable, a free-standing, temporary canopy over a selected article, such as a food article. This structure includes, fundamentally, a thin flexible, and preferably transparent, sheet canopy material prepared, appropriately, into pre-selected sizes (typically squares or rectangles) and one or more elongate plastically and elastically bendable ribs, made, for example, of a suitable plastic or wire material, which can be bent to the shape of a vaulting arch, which shape is capable substantially of retaining, and which functions as a support over which the canopy sheet material is placed. Opposite ends of such a rib in use may be tucked into articles which form part of the environment of the article which is being covered, or they may be supported in removeably attachable feet that are reusable and are supplied with the rib and sheet material.

10 Claims, 3 Drawing Sheets

TEMPORARY CANOPY STRUCTURE

BACKGROUND AND SUMMARY OF THE INVENTION

The invention pertains to apparatus for creating, very easily and simply, a removable, temporary protective canopy or shroud over food or some other article. A preferred embodiment, and several modifications, of the invention are specifically described herein in conjunction with covering food articles, an area of use wherein the invention has been found to offer particular utility. Those skilled in the art will recognize, from considering the food environment discussed herein, how the invention can readily be adapted for use in other settings.

As most people will know, there are many instances relating to preparing, serving, or otherwise working with food, where it is desirable to place a protective shroud or canopy over one or more selected food articles, and very preferably, to do this in a fashion which is quick, easy, effective, inexpensive, removable, and in fact, "throw-away" so-to-speak. It may also be desirable, and often is, to provide such a temporary protective canopy which one can see through so as to be able to identify quickly and clearly just what it is that is beneath the protective covering.

In many instances, the article of food covered will either be free-standing (such as a cake), or held in a dish, and placed out in the open, for example, in a kitchen. In other instances, such food may be placed in a more closed environment, such as in a refrigerator, or a microwave oven.

The present invention, in several different and very useful embodiments which are disclosed herein, addresses each of these several conditions and environments in a simple, inexpensive and practical manner.

Proposed according to a preferred embodiment of the invention is what can be thought of as a user system or kit containing, fundamentally, two, and in one modification three, different cooperative canopy-structure articles that coact according to the invention to create the mentioned kind of temporary canopy. According to this embodiment of the system, and particularly in relation to the two-article variety of the system, packaged and provided to the user are system components including (1) a plurality of pre-sized, clear, plastic, very flexible canopy sheets, along with (2) an appropriately numbered collection of elongate, slender, springy, but plastically bendable and deformable, support ribs which can be employed to support these sheets in an elevated, vaulting and arched condition over an article to be covered. The material making up the ribs, preferably, can selectively be bent quite significantly, and without breaking, so as to form a plastically deformed (but with retained elasticity), configurationally stable arch whose opposite ends may be supported in any suitable manner (to be described below). The plastic sheets which are preferably employed (other materials are possible as well), and the ribs, are made of very low-cost, easily manufactured and packaged, readily throwaway materials. Also, the sheets in the system are preferably formed of a transparent material so that a user can easily see that which is covered when the sheets are put to use. Further, the materials selected for the sheets and ribs are preferably usable in, and compatible with, both the refrigerator and the microwave-oven environments mentioned above.

According to various modifications of the system of the invention, the sheet and rib elements thereof may be suitably stored in dispensing packaging, either (a) as individual elements, (b) as compacted coils of elements, or (c) in other manners. Coiled elements can conveniently be drawn (paid) out through suitable package openings, and can be prepared, during manufacture, with pre-placed notches, perforations, etc. that enable quick and easy separation into usable components having defined unit lengths and sizes, or multiples of such lengths and sizes. The sheets preferably have four-sided, rectilinear perimetral outlines, and the ribs preferably have lengths which are substantially the same as one of the side lengths of the sheets.

While in the most simple form of the invention the sheets and ribs may begin their "lives", so-to-speak, as initially separated (individuated) items, certain modifications of the invention feature constructions wherein the sheet canopy material is furnished with elongate, tubular loops or sleeves for receiving and containing one or more ribs. Such loops or sleeves may be preconstructed to hold "captured" ribs, or they may be appropriately open to receive user-inserted ribs.

Transparency in the sheet material, while not a necessary feature of the invention, is nonetheless a feature which many users will consider to be an important convenience. Also, it is not a requirement of the invention that either or both of the two fundamental constituents (sheets and ribs) of the invention be made of throw-away materials. They could, for example, be made of materials that can easily and safely (from the standpoint of food contamination issues) be capable of being re-used and re-stored for many later uses. Further, and, preferably, such materials can confidently be used without fear of their contaminating food articles.

These and other objects and advantages which are attained by the invention will become more fully apparent as the description that now follows is read in conjunction with the accompanying drawings.

BRIEF DESCRIPTION OF THE DRAWINGS

FIG. 6 is also employed to illustrate a second, slightly modified way of using the system of the present invention.

DETAILED DESCRIPTION OF, AND BEST MODE FOR CARRYING OUT, THE INVENTION

Figure 1:
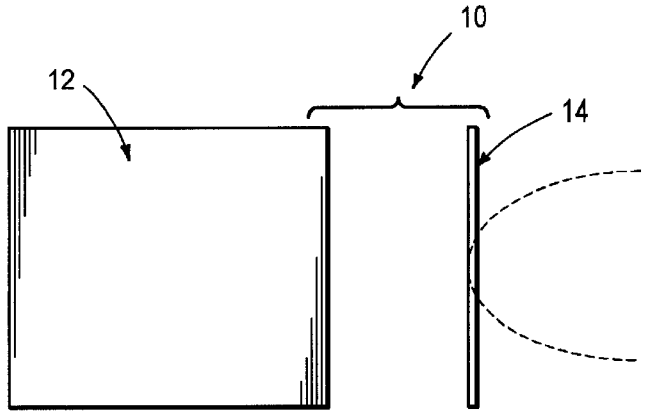
FIG. 1 is a view illustrating the two fundamental canopy-forming constituents of the present invention illustrated in side-by-side separated and unconnected conditions.

Turning now to the drawings, and referring first of all to FIG. 1, here generally illustrated at 10 are the two fundamental components which make up the preferred embodiment of the present invention. These components include a selected-size canopy sheet 12 of, preferably, a very thin and flexible plastic material, such as polyethylene material, (shown as a simple, square rectangle), and an elongate, springy, yet somewhat plastically bendable, plastic rib 14. Rib 14 may be formed, for example, of a suitable plastic material. It can also be successfully formed of a suitable category of wire, or of various other kinds of materials which can perform with a certain amount of plastic memory, and with a certain level of retained springiness. Plastic deformability with retained springiness is illustrated for rib 14 in dashed lines in FIG. 1, wherein it is shown bent between its opposite ends into an arching U-shape. Rib 14, so bent, preferably retains this bent condition.

The specific sizes of these elements are indeed matters of choice, but just for the sake of illustration herein, four-sided sheet 12 has a side length of about 12–18-inches. Rib 14 herein has an overall length which is also about 12–18-inches. As will become apparent, these various dimensions are very much matters of choice, and are selectable in accordance with the particular kinds of covering situations contemplated for the particular system components. Preferably the length of the ribs is about equal to one of the side-to-side dimensions of the sheets.

Figure 2:
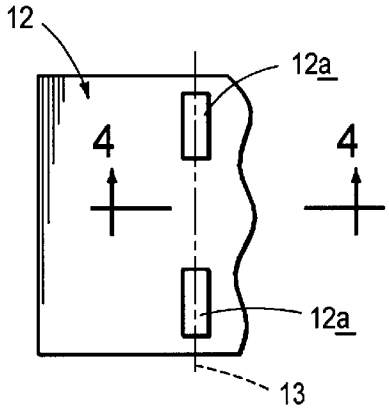
FIG. 2 is a fragmentary view illustrating a modified form of canopy sheet material constructed in accordance with the invention.
Figure 4:
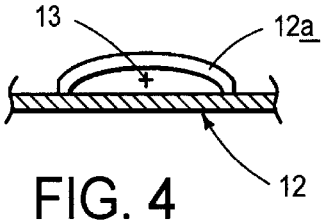
FIG. 4 is an enlarged, fragmentary, cross-sectional view taken generally along the line 4—4 in FIG. 2.

FIG. 2 shows a modified form of the invention wherein canopy sheet 12 is equipped with two, short, aligned, tubular loops or sleeves 12*a*. These sleeves, aligned as shown along a line 13, are preferably formed of the same material which makes up sheet 12. FIG. 4 shows how one of these sleeves appears from the point of view of line 4—4 in FIG. 2. Sleeves 12*a* are provided as a convenience for defining a holding and receiving passageway for a rib 14 during use. Such a holding and reception condition is illustrated in FIG. 5.

Figure 3:
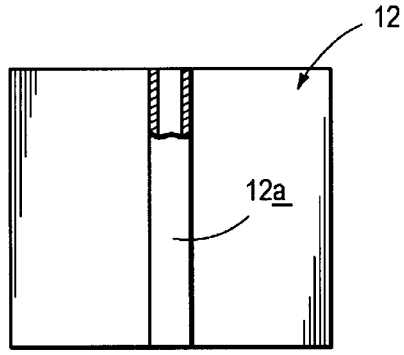
FIG. 3 is a view of yet another modified form of canopy sheet material constructed in accordance with the invention, and with a portion therein broken away to illustrate details of construction.
Figure 5:
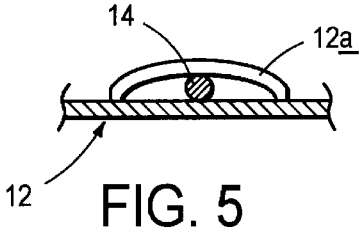
FIG. 5 is a view which is very much like that which is presented in FIG. 4 except that it shows a rib installed in sleeve structure prepared with canopy sheet material in accordance with a modification of the present invention.

FIG. 3 illustrates yet another embodiment of the invention which takes the form of a rectangular sheet 12, which is like previously-mentioned sheet 12, formed with a single, elongate, rib-receiving sleeve 12*a*, which is a long version of previously-mentioned loops 12*a* pictured in FIGS. 2, 4 and 5. This form of sleeve 12*a* may either be singly, or doubly open-ended to permit selectable user inserting of a rib, or it may be supplied to a user with a rib-already in place, with opposite ends of the sleeve sealed to capture such a rib.

As supplied to a user, a system constructed generally in accordance with any one of the embodiments so far generally described, is preferably packaged with the selected number of sheets for such a supply provided in a packaged stack, and with the appropriate number of ribs either bundled as separate units, or pre-sealed in sleeves, such as a sealed-end sleeve 12*a* as described just above with respect to FIG. 3. These illustrated plural embodiments of the invention are ones wherein what can be thought of as the overall use sizes of the sheet and rib elements have been predetermined in dimension.

Figure 6:
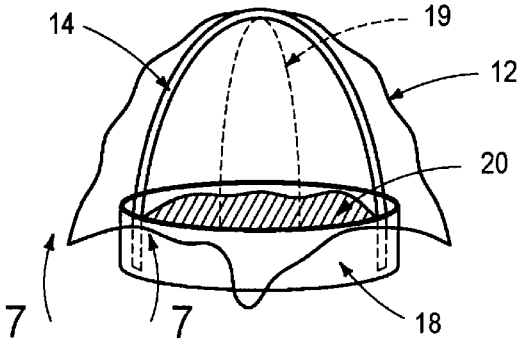
FIG. 6 is a side elevation, not necessarily drawn to scale with respect to any other ones of the drawing figures so far mentioned, illustrating the elements of the invention which are pictured in FIG. 1 in use forming a canopy over a container of food in accordance with use of the present invention. As will be explained below.

FIGS. 6, 7, 9 and 10 generally illustrate the system of the invention in several alternative conditions installed for canopy use with respect to a cylindrical dish 18 which holds a quantity of a food article 20. As the system is pictured in solid lines in FIG. 6, a single rib and a single canopy sheet are shown in use. The opposite ends of rib 14, which rib has been appropriately bent to provide a vaulting archway over food container 18, are suitably tucked into opposite sides of dish 18. With rib 14 arch-shaped as generally shown in FIG. 6, and supported as described, the rib tends to retain the arching shape pictured in FIG. 6, both because of plastic deformation which has taken place in the rib as a consequence of initial bending thereof, and also because of the fact that its opposite ends are tucked into dish 18. Sheet 12 is draped over the rib, and together therewith forms a substantially completely overcovering protective canopy with respect to container 18 and food 20.

Still referring to what is shown in FIG. 6, pictured therein by dash-double-dot line 19 is a representation of how a second rib 14 might additionally be employed. Such an additional rib would be bent to form an arch very much like that which is shown for rib 14 in FIG. 6, with the opposite ends of this other rib also suitably tucked into dish 18 on approximately diametrally opposite sides of the dish.

Figure 7:
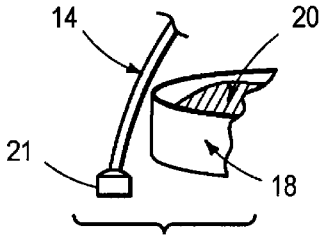
FIG. 7 is a fragmentary detail taken generally in an area like that embraced by the double curved arrows 7—7 in FIG. 6, illustrating a modified form of the invention wherein the opposite ends of a rib are supported for use by removably attached anchoring feet.

FIG. 7 illustrates a modified form of the invention (in this figure the sheet canopy material has been omitted) wherein what is supplied to the user, along with canopy sheets and ribs, are two or more easily installable and removable anchor feet, such as the anchor foot shown at 21 in FIG. 7. These anchor feet are suitably furnished with sockets, or other forms of reception openings, that can receive the opposite ends of a rib, such as is shown specifically in FIG. 7, to stabilize a rib in an arched condition over an article without relying upon tucking the opposite ends of the rib into something directly associated with that article.

Figure 9:
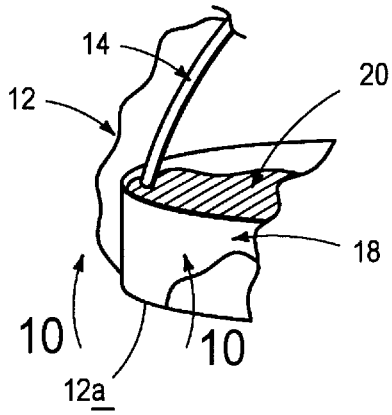
FIG. 9 is yet another fragmentary view, also taken generally in an area like that embraced by arrows 7—7 in FIG. 6 illustrating use of the invention in a setting very much like that which is pictured in FIG. 6, but specifically where corner regions of a draped canopy sheet are tucked beneath a food container for further stabilization of the system during its use in accordance with the invention.
Figure 10:
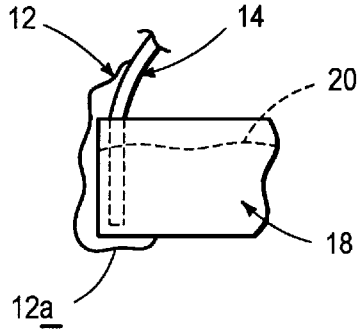
FIG. 10 is an enlarged, fragmentary view taken generally in the area braced by curved arrows 10—10 in FIG. 9.

FIGS. 9 and 10 illustrate an alternative way of employing the ribs and sheets of the present invention in a manner which is very much like that illustrated in FIG. 6, but with the added consideration that, for example, the opposite sheet corners, such as corner 12*b* pictured in FIGS. 9 and 10, are tucked underneath dish 18 so as further to stabilize the condition of the canopy system when in use.

Figure 8:
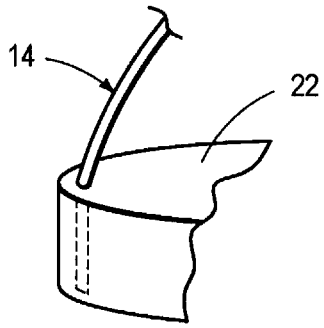
FIG. 8 is a view, taken in an area which can be likened to the area embraced by arrows 7—7 in FIG. 6, illustrating use of the invention wherein opposite ends of a rib are actually tucked directly into the substance of a food article, such as a cake, during use of the system of the invention.

FIG. 8 illustrates use of the system (here, also, the canopy sheet material is omitted from the view) in relation to providing a protective canopy over an article such as cake 22. In this illustrated use of the system of the invention, opposite ends of rib 14 are simply driven downwardly into the body of the cake per se to stabilize it during canopy use.

Figure 11:
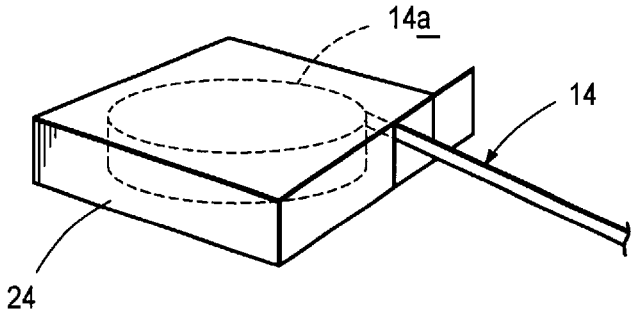
FIG. 11 is a simplified and fragmentary view illustrating one way of packaging and delivering rib material constructed in accordance with the invention.
Figure 12:
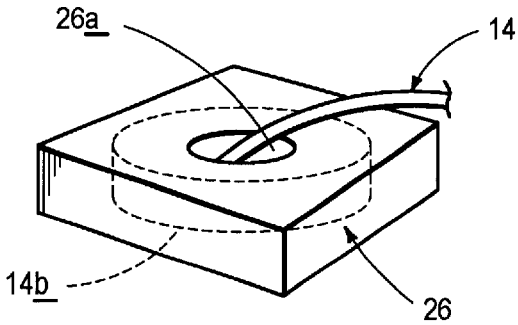
FIG. 12 is a view which is somewhat similar to that presented in FIG. 11, here showing yet another way of packaging for delivery elongate rib material constructed in accordance with the present invention.

FIGS. 11 and 12 illustrate two different ways in which a modified form of rib structure 14 may be prepared, packaged and provided to a user. In FIG. 11 what is illustrated is what begins as a single, very long run or stretch of rib material 14, formed into a coil 14*a* which lies in a kind of flat, pancake fashion within a suitable dispensing package 24. As rib material is accessed for use, the user simply pulls outwardly on an exposed length of rib material, and in any suitable fashion, after drawing or paying the same out from the interior of container 24, appropriately cuts or breaks off the desired rib length.

FIG. 12 illustrates a long run of rib material 14 formed into a flat, pancake coil 14*b* which resides in a suitable package 26 having a top opening 26*a* from which rib material is drawn outwardly for separation of an appropriate use length.

Figure 13:
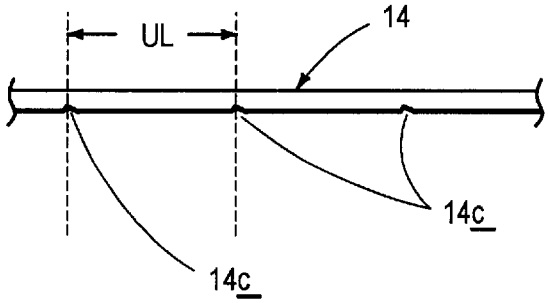
FIG. 13 is an enlarged, fragmentary view of an elongate run or stretch of rib material prepared in accordance with the invention as a unitary (initially) long run marked with plural, distributed, generally evenly spaced separation notches in accordance with a modified feature proposed in accordance with the invention.

FIG. 13 illustrates another modified form of the invention, wherein a long run of initially unitary rib material 14, such as the runs which are contained within packages 24, 26 as just described, is prepared with plural, and in this case, evenly spaced and distributed, pre-formed notches, such as notches 14*c*, that effectively mark off what can be thought of as pre-determined unit lengths (one being designated at UL in FIG. 13) that prepare the rib material for easy breaking apart or cutting into desired use lengths.

Figure 14:
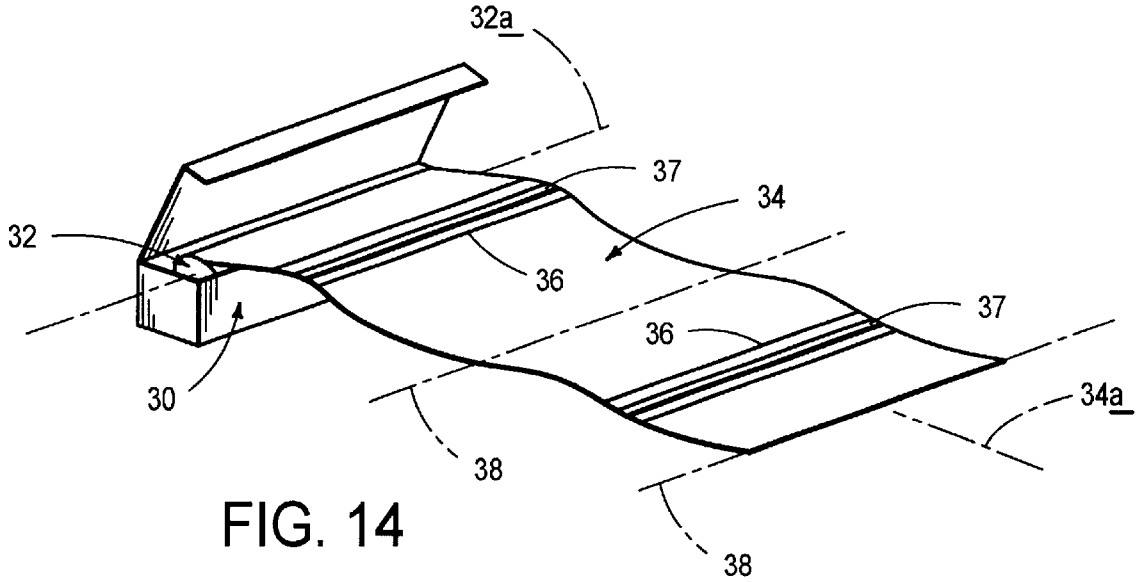
FIG. 14 is a simplified perspective view illustrating another way of packaging components constructed in accordance with the present invention, and specifically, illustrating packaging of combined elements (rib and canopy sheet material) in a box-held dispensable roll.

FIG. 14 shows still another embodiment of the invention, and namely one with respect to which ribs and canopy sheet material are pre-assembled relative to one another, and are furnished in the form of a pay-out roll of combined elements. Thus, shown in FIG. 14 is an elongate box 30 having an open top which exposes a contained roll 32 of combined material (canopy sheet and ribs). This combined material takes the form of a rolled, elongate stretch, or ribbon, 34 of canopy sheet material, like the canopy-sheet material previously mentioned. The long axis of material 34 is shown at 34*a*, and this long axis, with respect to the illustrated, paid out stretch of material 34, is substantially normal to the long axis 32*a* of roll 32. Sheet material 34 is furnished on one of its sides with plural, generally evenly spaced, elongate sleeves 36 which extend across the width of the material as shown. Each of these sleeves contains a captured, pre-installed rib 37 which is like previously-mentioned ribs 14.

Preferably, sheet material 34 is marked and/or perforated along lines generally dividing the sheet material into equidistant lengths between adjacent rib-receiving sleeves. Such lines are shown generally as dash-triple-dot lines 38 in FIG. 14. Conveniently, these lines define locations where a user may easily tear away (or otherwise separate) defined lengths of the combined material, depending upon the use application intended. Box 30, if so desired, may be equipped with a conventional type of serrated or sharpened edge to aid in sheet/rib separation.

Figure 15:
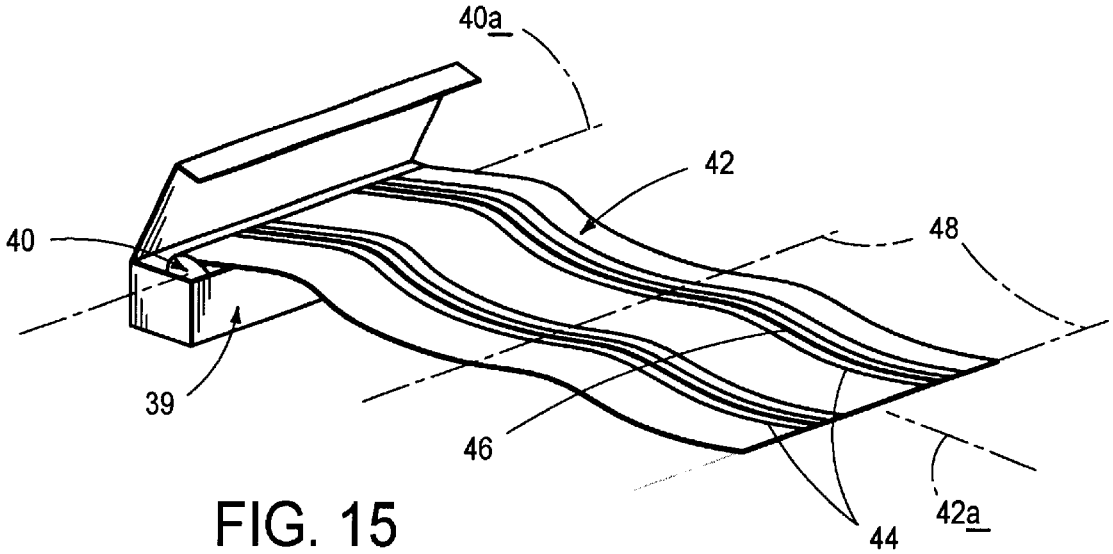
FIG. 15 is a very similar in presentation to FIG. 14, except that here what is shown is another packaging and delivery arrangement for presenting and delivering combined system components of the invention, with the components in this arrangement organized quite differently from the way in which these similar components are organized in the manner shown in FIG. 14.

Turning attention now to FIG. 15, here there is illustrated still another modified form of the invention which is somewhat like the embodiment that has just been described in conjunction with FIG. 14. In FIG. 15, there is shown an elongate, open-topped box 39, which is very much like previously-mentioned box 30. Box 39 containing an elongate roll 40 of combination material that is somewhat like the combination material described in conjunction with FIG. 14. Roll 40 has a roll axis 40*a*, and contains a long strip 42 of canopy sheet material, like the canopy sheet material so far described, on and along the upper side of which in FIG. 14 there are provided two, continuous, elongate, laterally-spaced sleeves, such as those shown at 44. Sleeves 44 are disposed in a lengthwise direction relative to the long axis 42*a* of canopy material 42, and are spaced apart by an appropriate distance. Received within these long sleeves are long contained runs of rib material 46, which is like the rib material previously described. Conveniently, and at preselected unit lengths distributed along the length of sheet material 42, there are plural, spaced notch and perforation structures (see lines 48) which are provided for easy selective separation and removal of different overall lengths of combined material intended for use. A sharpened/serrated edge may also be provided with a box like box 39.

Figure 16:
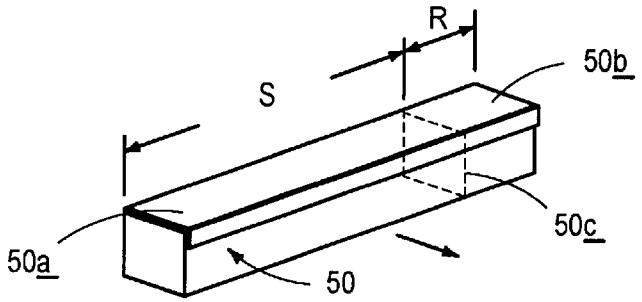
FIG. 16 is yet another perspective view illustrating still another way of dispensing system components (rib structure and canopy sheet material) in accordance with the invention.

Turning attention now finally to FIG. 16, here there is indicated generally at 50 a double-sided elongate box which may be used to package canopy sheet and rib materials in accordance with the present invention. Box 50 is provided with two side-by-side opening lids 50*a*, 50*b* which define the openable tops of two side-by-side container spaces provided within box 50, which spaces may be defined internally by a separation wall shown generally at 50*c*. The portion of box 50 which lies beneath lid 50*a*, indicated at S, is a region wherein a long run or strip of canopy sheet material may be stored for dispensing from a roll contained in this region. The portion of box 50 lying beneath lid 50*b*, and marked off in FIG. 16 at R, is a region in box 50 which contains a coiled, elongate run of rib material, such as rib material 14.

It will thus be apparent that the system of the present invention furnishes a very simple and very effective arrangement for quickly, easily and handily covering various articles, such as food articles. All of the advantages ascribed to this system earlier will be seen to be attained by each of the embodiments of the system which have been illustrated and described herein. Specific sizes and specific materials employed for different particular applications are completely matters of choice. Various modifications have been illustrated and described and others are certainly possible. For example, sleeves for receiving ribs have been described herein as being formed on one side (or force) of sheet canopy material, but, for example, such sleeves could be created in other manners.

While the invention has been disclosed in a particular setting (the covering of food articles) in a preferred form herein, the specific embodiments thereof as disclosed and illustrated herein are not to be considered in a limiting sense. Numerous variations, for example, variations appropriate for the covering of articles other than food articles, are possible. Applicant regards the subject matter of her invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as useful, novel and non-obvious. Other such combinations and subcombinations of features, functions, elements and/or properties may be claimed through amendment of the present claims or through presentation of new claims in this or in a related application. Such amended and/or new claims, whether they are broader, narrower or equal in scope to the originally presented claims, are also regarded as included within the subject matter of applicant's invention.

What is claimed is:

1. Canopy structure for creating, selectively and removably, a free-standable, temporary domelike, substantially completely overcovering canopy over a selected article, such as a food article, comprising a plastically/elastically bendable, at least partially shape-self-supporting, elongate rib, bendable and selectively plastically deformable between opposite ends to assume and retain with memory the shape, generally, of a configurationally stable, elongate arch which is freely placeable in a vaulting, overarching condition over a selected article, and a cooperating, thin, flexible and drapeable, canopy sheet structured so that when it resides in an operative condition relative to said rib, and to an article overarched by the rib, the sheet rests in a draped disposition curving over and along a length of the rib, and in a condition substantially fully covering the article.

2. The canopy structure of claim 1, wherein said canopy sheet is four-sided and rectilinear in perimetral outline, and said rib has a length which is substantially the same as the length of one of the four sides of said sheet.

3. The canopy structure of claim 1, wherein said sheet includes an elongate sleeve structure, and said rib and said sheet, when disposed in operative conditions relative to one another, are arranged with said rib disposed within said sleeve structure.

4. The canopy structure of claim 3, wherein said rib is confined by and captured in said sleeve structure.

5. Canopy structure for creating, selectively and removably, a free-standable, temporary, substantially completely overcovering canopy over a selected article, such as a food article, comprising an elongate, broad ribbon of a thin, flexible and drapeable canopy sheet material formed into an elongate roll having and curled about an elongate roll axis which is generally normal to the sheet material's long axis, a plurality of elongate sleeve structures formed with said sheet material, and defining there adjacent a plurality of elongate tubular sleeves, and disposed within said sleeves on a one-to-one basis, and carried in said roll as presented to a user, plural, elongate, plastically/elastically bendable, and at least partially shape-self-supporting ribs, each said rib being bendable selectively between selectable rib-end regions to assume and memorize the shape, generally, of a configurationally stable, elongate curving arch which is freely placeable over a selected article, said rib, when so bent and placed, supporting a selected stretch of said sheet material in a vaulting, domed condition that is related to the arch created in the rib between the rib's said selected rib-end regions.

6. The canopy structure of claim 5, wherein said sleeves and received ribs have long axes which are disposed generally parallel to said roll's said roll axis.

7. The canopy structure of claim 5, wherein said sleeves and received ribs have long axes which are disposed generally normal relative to said roll's said roll axis.

8. The canopy structure of claim 1, wherein said rib takes the form of a separated and segregated length portion of an initially longer run of rib material which is initially supplied to a user along with canopy sheet material, and said length portion is one that is length-defined by at least one pair of spaced, pre-formed segregation notches prepared at defined, spaced locations distributed in and along said longer run.

9. The canopy structure of claim 7, wherein said ribs are initially supplied to a user configured in the form of a unitary coil.

10. The canopy structure of claim 1, wherein said canopy sheet takes the form of a separated and segregated length portion of an initially longer run of sheet canopy material which is initially supplied to a user along with rib material, and said length portion is one that is length-defined by at least one pair of spaced, pre-formed perforation lines prepared at defined, spaced locations distributed in and along said longer run.

* * * * *

UNITED STATES PATENT AND TRADEMARK OFFICE

CERTIFICATE OF CORRECTION

PATENT NO. : 6,502,594 B1
DATED : January 7, 2003
INVENTOR(S) : Gail L. Gerstmar It is certified that error appears in the above-identified patent and that said Letters Patent is hereby corrected as shown below:

Drawings,
Sheet 2 of 3, delete Figs. 9 & 10 and substitute therefore Figs. 9 & 10 as shown on the attached page.

Signed and Sealed this

Twenty-ninth Day of July, 2003

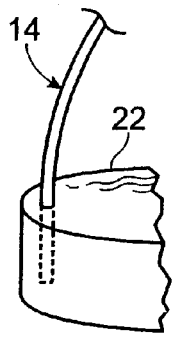
FIG.8
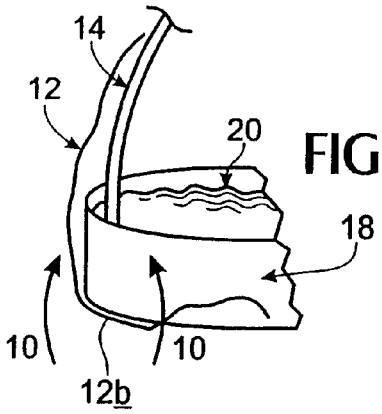
FIG.9
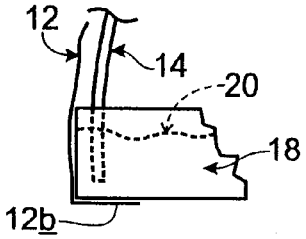
FIG.10
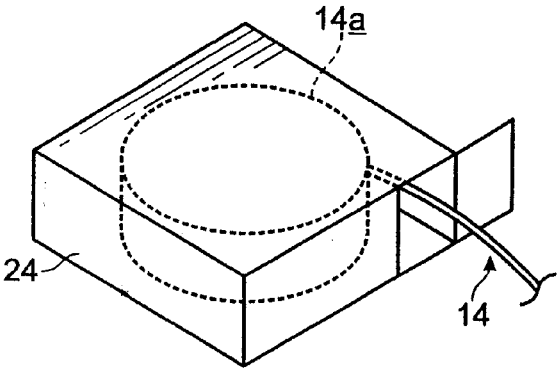
FIG.11
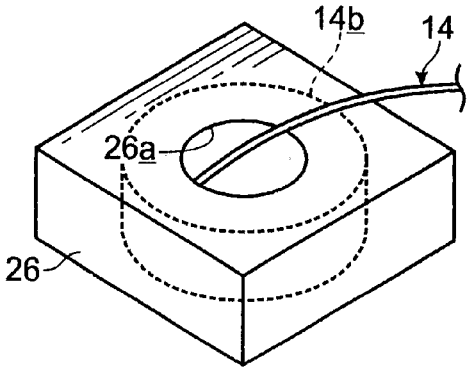
FIG.12
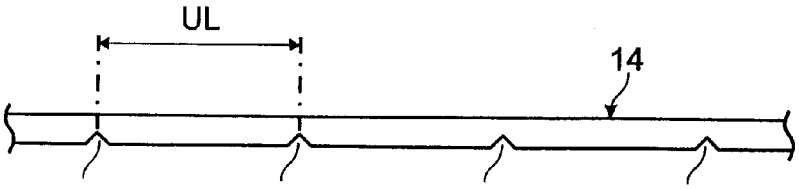

JAMES E. ROGAN
*Director of the United States Patent and Trademark Office*